US007719549B2

(12) United States Patent
Potucek

(10) Patent No.: US 7,719,549 B2
(45) Date of Patent: May 18, 2010

(54) COLOR CHANGING IMAGE WITH BACKLIGHTING

(75) Inventor: Kevin L. Potucek, Far Hills, NJ (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 1250 days.

(21) Appl. No.: 10/974,081

(22) Filed: Oct. 27, 2004

(65) Prior Publication Data

US 2005/0088434 A1 Apr. 28, 2005

Related U.S. Application Data

(60) Provisional application No. 60/515,090, filed on Oct. 28, 2003.

(51) Int. Cl.
*G09G 5/10* (2006.01)

(52) U.S. Cl. ..... 345/690; 345/102; 345/589; 358/453

(58) Field of Classification Search ..... 345/626, 345/5–8, 690, 102, 589; 348/671; 382/163–167, 382/169, 171, 174, 282; 358/3.1, 452, 453
See application file for complete search history.

(56) References Cited

U.S. PATENT DOCUMENTS 4,975,861 A * 12/1990 Fujimoto ..... 345/602
5,051,875 A 9/1991 Johnson
5,155,589 A * 10/1992 Gere ..... 348/29
5,506,946 A * 4/1996 Bar et al. ..... 345/600
5,842,771 A 12/1998 Thrasher et al.
6,002,216 A 12/1999 Mateescu
6,174,067 B1 1/2001 Thrasher et al.
6,241,361 B1 6/2001 Thrasher et al.
6,379,025 B1 4/2002 Mateescu et al.
7,046,390 B2 * 5/2006 Atkins ..... 358/1.2
2002/0071279 A1 * 6/2002 Katogi et al. ..... 362/317
2002/0130627 A1 9/2002 Morgan et al.
2002/0144441 A1 * 10/2002 Zentmire et al. ..... 40/575
2002/0153851 A1 10/2002 Morgan et al.
2002/0163316 A1 11/2002 Lys et al.
2002/0171377 A1 11/2002 Mueller et al.
2002/0171378 A1 11/2002 Morgan et al.
2004/0212993 A1 10/2004 Morgan et al.

* cited by examiner

*Primary Examiner*—Amare Mengistu
*Assistant Examiner*—Hong Zhou
(74) *Attorney, Agent, or Firm*—Greenberg Traurig, LLP

(57) ABSTRACT

The present invention provides a method of making an imaged media and a method of displaying an image, comprising the steps of providing a color image, creating a modified image by transforming a first color portion of the color image into a gray-scale portion, wherein a second color portion of said color image remains in color in said modified image, and reproducing said modified image on a fully or partially light transmitting media which can be used to display the modified image in color.

3 Claims, 3 Drawing Sheets

CREATION AND DISPLAY OF A COLOR IMAGE WITH LOCALIZED GRAY-SCALE

COLOR CHANGING IMAGE WITH BACKLIGHTING

This application claims the benefit of provisional patent application Ser. No. 60/515,090 filed on Oct. 28, 2003, incorporated herein by reference.

This application relates generally to a means for displaying a lighted image. More specifically, this application relates to a means for displaying a colored image on large areas using an image that has been at least partially converted to grayscale displayed using colored backlighting.

BACKGROUND OF THE INVENTION

With growth of the color changing illumination market, there has been a challenge in effectively demonstrating and/or representing the effects of color changing illumination on large areas or objects such as swimming pools, architecture etc.

This is presently attempted by expensive, yet relatively ineffective, video, or by still color photography. This still photography is sometimes shown as color photographs with white front lighting or as color transparency with white backlight.

There is also demand for eye-catching marketing displays, including Point-of-Purchase (PoP) displays that use color lighting or even color changing lighting for grabbing attention.

These PoPs typically use mechanical, moving, secondary objects or transparencies as part of the primary image or in front of or behind the primary image. They may use fiber-optics to create color-changing points of light. These solutions typically require labor intensive construction, including sign and letter masking, as well as fiber placement and complex color wheel design.

It would be desirable to solve these problems and shortcomings in a cost-effective and satisfactory manner. Point of purchase displays, night-display billboards, trade-show displays, portable salesman displays, home or office décor/novelty, training aid could all utilize an effective solution.

SUMMARY OF THE INVENTION

Provided is a method of making an imaged media comprising the steps of providing a color image, creating a modified image by transforming a first color portion of the color image into a gray-scale portion, wherein a second color portion of said color image remains in color in said modified image, and reproducing said modified image on a fully or partially light transmitting media.

Further provided is a method of making an imaged media comprising the steps of providing a color image, creating a modified image including the steps of transforming a first color portion of the color image into a gray-scale portion, and fixing a color density of a second color portion of the color image, and reproducing said modified image on a fully or partially light transmitting media.

Further provided is a method of displaying an image comprising the steps of providing a color image, creating a modified image by transforming a color portion of the color image into a gray-scale portion, wherein some other portion of said color image remains in color in said modified image, reproducing said modified image on a fully or partially light transmitting media, and illuminating said fully or partially light transmitting media with a colored light source to generate an illuminated image in color.

Further provided is a method of displaying an image comprising the steps of providing a color image in electronic format, creating a modified image in electronic format including the steps of using a computer to transform a first color portion of the color image into a gray-scale portion, and using a computer to fix a color density of a second color portion of the color image, reproducing said modified image on a fully or partially light transmitting media, and illuminating said fully or partially light transmitting media with a colored light source to generate an illuminated image in color.

Further provided is a method of displaying an image comprising the steps of providing a color image, creating a modified image by converting a first color portion of the color image into a gray-scale portion, wherein a second color portion of the color image remains in color in the modified image, reproducing said modified image on a fully or partially light transmitting media, and illuminating said fully or partially light transmitting media with a colored light source to generate an illuminated image in color, wherein said colored lights are controlled to produce a dynamic coloring effect, and wherein said second color portion is displayed substantially in its original color as in said color image, and further wherein said gray-scale portion is displayed in a shaded color due to said dynamic coloring effect.

Further provided is an image display system comprising a fully or partially light transmitting media having a modified image thereon, said modified image including a first portion in gray-scale taken from a portion of a color image, wherein the colors of said portion are provided in gray-scale, and a second portion in color taken from another portion of the color image, a colored light source for providing a plurality of colors for illuminating said fully or partially light transmitting media to display said modified image, and a controller for controlling said colored light source, wherein said colored light source is controlled by said controller to produce a dynamic coloring effect, and wherein said second portion is displayed by said light source in substantially its original color as in said color image, and further wherein said first portion is displayed by said light source in a shaded color due to said dynamic coloring effect.

Further provided is a method of displaying an image comprising the steps of providing a color image in electronic format, creating a modified image including the steps of using a computer to convert a first color portion of the color image into a gray-scale portion, and using a computer to fix a color density of a second color portion of the color image which thereby remains in color, and printing said modified image onto a fully or partially light transmitting media, illuminating said fully or partially light transmitting media with a colored light source providing a plurality of colors to generate an illuminated image, and controlling said colored light source to produce a dynamic coloring effect, wherein said second color portion is displayed substantially in its original color as in said color image, and wherein said gray-scale portion is displayed in a shaded color due to said dynamic coloring effect.

DETAILED DESCRIPTION OF THE PREFERRED EMBODIMENTS

Figure 1:
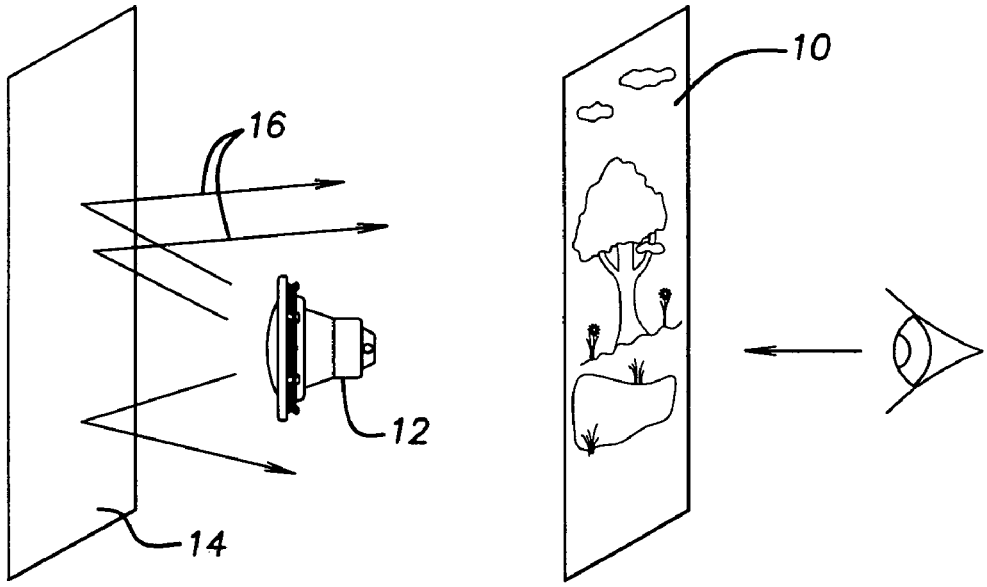
FIG. 1 is a schematic diagram of an implementation of the invention using a reflective backplane for utilizing one or more color changing light fixtures.

As used herein, imaged media refers to a media upon which an image has been reproduced. The media could be any fully or partially light transmitting media, for example single or multi-layered transparent or translucent plastic film, hard plastic, polycarbonate, PVC, glass, ceramics, crystals, transparency film, including combinations thereof. An imaged media can be created by reproducing an image on the media by methods known or to be developed in the image reproduction art. For example, the image could be printed or drawn onto the media using a computer printer, copier, or plotter. Alternatively, the image could be transferred or printed through some other method known in the art, for example painted onto the media, or infused into the media when the media is constructed.

As used herein, colored lights (colored lighting) refers to lights other than white light. Colored light includes filtered white light wherein white light is filtered to produce non-white light. Examples of colored lights include red, blue, green, yellow, purple, and combinations thereof. Black lights using lights that emit ultraviolet light might also be utilized.

Provided is a means for displaying a color image using a color photographic imaged media of illuminated object(s) and/or scene with localized image gray-scale and color-changing backlighting. Included is a means for displaying a color photograph that is taken of a desired subject or scene. The photograph can be created in digital/electronic format or converted to electronic format to facilitate color manipulation.

Areas of the photograph that are most affected by the color-changing illumination are then transformed to gray-scale (gray-scaled or gray-scaling), which leaves this portion of the image to appear as a black and white portion when exposed to standard white illumination.

When the image is reproduced as an imaged media, it is then backlit with color-changing light. The portions of the image that are in the original photographic color mostly retain that original color. Portions of the image that have been gray-scaled will then transmit the colors of the color-changing backlight in a shading defined by the gray-scale image portions.

Gray-scaling can, in comparison to clear or white imaging, provide realistic shadowing and shading of the original image. The retained color portions of the image can have the color density fixed to control the impact of the colored or color-changing lighting on its portion of the image.

Some color-changing effects on these portions of the image are typically desired to better simulate the color lighting reflected by the primary subject.

A method and apparatus is provided for use as a sales-aid for demonstrating the effect of color changing illumination on a subject or scene using color changing lighting, for example color changing backlighting, of an imaged media, developed or otherwise produced in color and other image areas printed, developed or otherwise produced in gray-scale. Further, the method and apparatus can be used for decorative lighting effects for pools, buildings, rooms, offices, and many other locations.

To implement the method, a color image can be captured of a desired subject or scene. The captured image can be created in digital (electronic) format or using traditional photography, and then converted to electronic format to facilitate color manipulation. Further, images could be created by artistic means, rather than by photograph.

Then, the image is modified (transformed) as follows: Portions of the photograph/image that are, for example, most affected by the color-changing illumination, are then gray-scaled, leaving that portion of the image to appear similar to a black and white photograph when exposed to standard white illumination. The gray-scaling is done using methods that are known or to be developed in digital photography and/or computer graphics fields. Other portions of the image are then left in color (and optionally density fixed as described herein). An imaged media is then created which incorporates the modified image including partially gray-scaled portions and the color portions onto or into a transparent or translucent medium (which is fully or partially light transmitting, respectively). Alternatively, the modified image could be placed on an opaque medium where reflected colored lighting is used to get the desired effect.

After the imaged media is created, it is then illuminated with a light, preferably a colored light, to form an illuminated image. In a more preferred embodiment, the imaged media is backlit with one or more color-changing lights. The portions of the image that are in its original photographic color mostly retain the original color, whereas portions of the image that have been gray-scaled will then transmit the colors of the color-changing backlight in a shaded manner. The imaged media may be indirectly backlit. Indirect backlighting may be achieved by reflecting light from the light source onto the imaged media by means known or to be developed in the image projection field.

Figure 2:
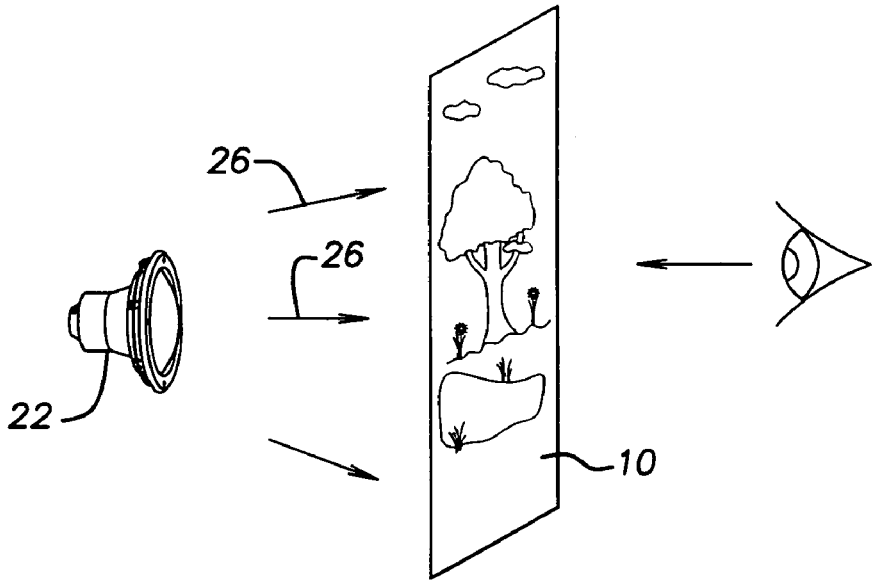
FIG. 2 is a schematic diagram of an implementation of the invention using direct lighting utilizing one or more color changing light fixtures.
Figure 3:
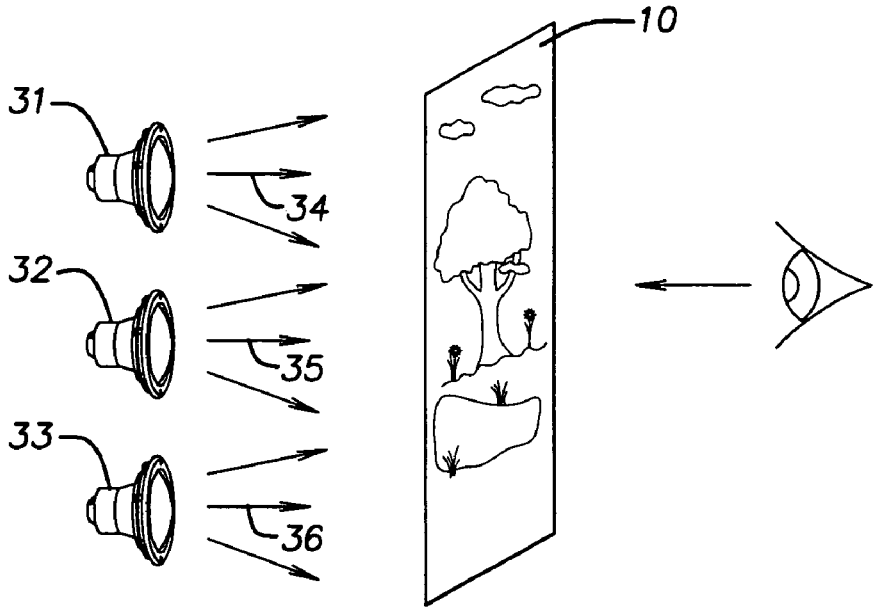
FIG. 3 is a schematic diagram of an implementation of the invention using direct lighting utilizing multiple light sources each of a different color.

In one embodiment, an imaged media having a partially gray-scaled image is built into a light box display system that includes colored light(s) or color-changing light(s). The color-changing light(s) directly or indirectly backlight the imaged media from within the light box. Typically, the imaged media can then be directly viewed by a person (direct viewing is shown in FIGS. 1, 2 and 3, for example).

Figure 5:
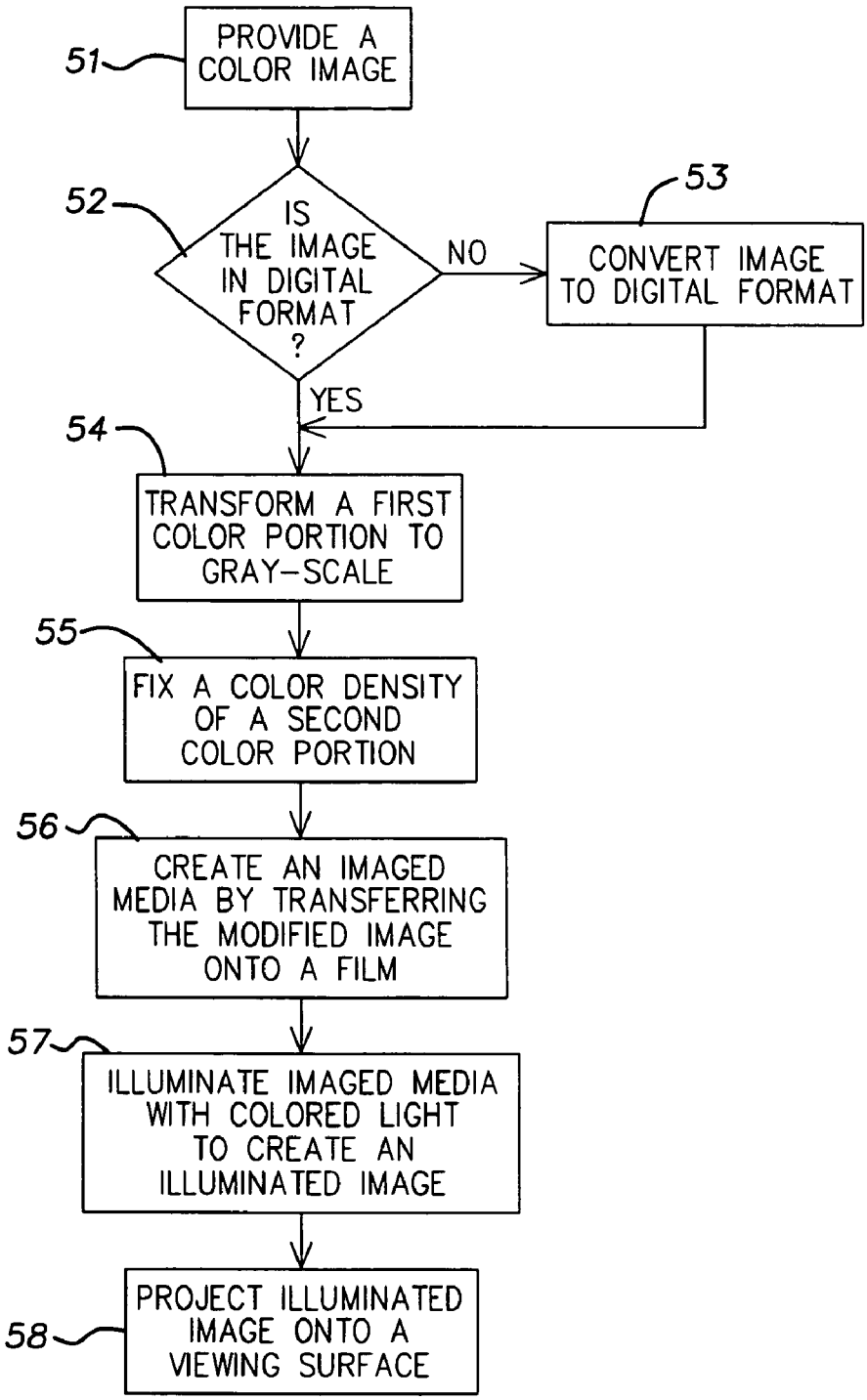
FIG. 5 is a flow chart of a preferred embodiment of the present invention for the creation and display of a color image with localized gray-scaling.

As can be seen in FIG. 5, in a preferred embodiment of the present invention, the creation and display of a color image with localized gray-scaling is provided for as follows:

1) provide a color image 51; then
2) if the image is not in electronic format 52, convert the image to electronic format 53; then
3) transform a first color portion to gray-scale 54; then
4) fix a color density of a second color portion 55; then
5) create an imaged media by transferring the modified image onto a transparency film 56; then
6) illuminate the imaged media with colored light to create an illuminated image 57; and then
7) project the illuminated image onto a viewing surface 58.

Note that for some implementations, some steps may be skipped. For example, fixing a color density may not be necessary for every implementation. As a further example, if an image is created electronically, such as by digital photography, there may be no need to convert the image to an electronic format. Furthermore, not all implementations will project the image onto a viewing surface.

Using gray-scaling, in comparison to clear or white imaging, can provide a more realistic shadowing/shading of the original image. The retained color portions of the image can have the color density fixed to control the impact of the color-changing lighting on its portion of the image, to emphasize or de-emphasize the colors, for example. The color density may be fixed, for example, by increasing the number of dots per inch in a retained color portion of the digital image. In a further example, the color density may be fixed by increasing the number of colored pixels in a retained color portion of the digital image. Some color-changing effects on these portions of the image are typically desired as they may better simulate the color lighting reflected by the primary subject.

The invention provides for the use of color-changing backlighting of a color and gray-scale imaged media to simulate the effects of color illumination on a subject.

Gray-scale portions of a photographic image, in combination with original color portions of the photographic image, are used to simulate the effects of color changing illumination of a subject when backlighting the image with color-changing lighting.

An image display apparatus according to the present invention includes an imaged media made by partially gray-scaling a color digital image as described herein, and illuminating the imaged media with a colored and/or color changing light source. In one preferred embodiment, the imaged media is backlit by the light source. In a further preferred embodiment, the light source (which may comprise a plurality of individually colored lights) selectably emits a plurality of colored light. The selection of color may be done manually, or automatically, such as by computer control. Additionally, the selection of color may be random or sequential. By mixing colors of individual lights, additional combinations of colors could be provided. Furthermore, white light could be provided by simultaneously mixing a sufficient number of colors of colored lights.

An image displayed in accordance with the present invention may be projected onto a viewing surface, for example a wall or a screen, to allow for viewing at a distance. Alternatively, the image could be viewed directly, or reflectively.

FIG. 1 shows a schematic of one implementation of the invention. A reflective backplane 14 reflects light 16 generated by one or more color changing light fixtures 12 onto or through an imaged media 10 of the image that has been at least partially gray-scaled. The light fixture(s) may project a single color light, or may change the color of light according to some desired pattern, sequence, or effect. The image may be viewed directly, or projected onto a surface for indirect viewing (see FIG. 4).

The image on the imaged media 10 could be partially gray-scaled. For example, the tree and plant in the image may remain in color while the pond and clouds have been gray-scaled. When illuminated by the one or more color changing light fixtures 12, the color portions of the image will mostly retain the original color. The pond and clouds, for example, which have been gray-scaled, will transmit the colors of the color changing light fixtures 12, so that the pond and clouds appear in those colors in a shaded or shadowed manner. The selection of colors emitted by the color changing light fixtures 12 may be changed randomly or sequentially, thereby providing visually pleasing effects to the viewer, for example, a simulated motion of the clouds and pond.

FIG. 2 shows an alternate implementation of the invention where the one or more color changing light fixtures 22 shine directly into the imaged media 10. Thus, no light reflection is necessary. Instead, the light rays 26 are shined directly through the imaged media 10. Otherwise, the apparatus, method, and effect are very similar to that of the implementation of FIG. 1.

FIG. 3 shows a still further implementation where three (or more) light sources 31, 32, and 33 may be used instead of a single light source. The three light sources are preferably of the primary colors red, blue, and green, although other color combinations can be used to generate different desired coloring effects. Thus, by controlling the intensity of each of the lights in a simple or complex manner, various color effects can be generated.

Figure 4:
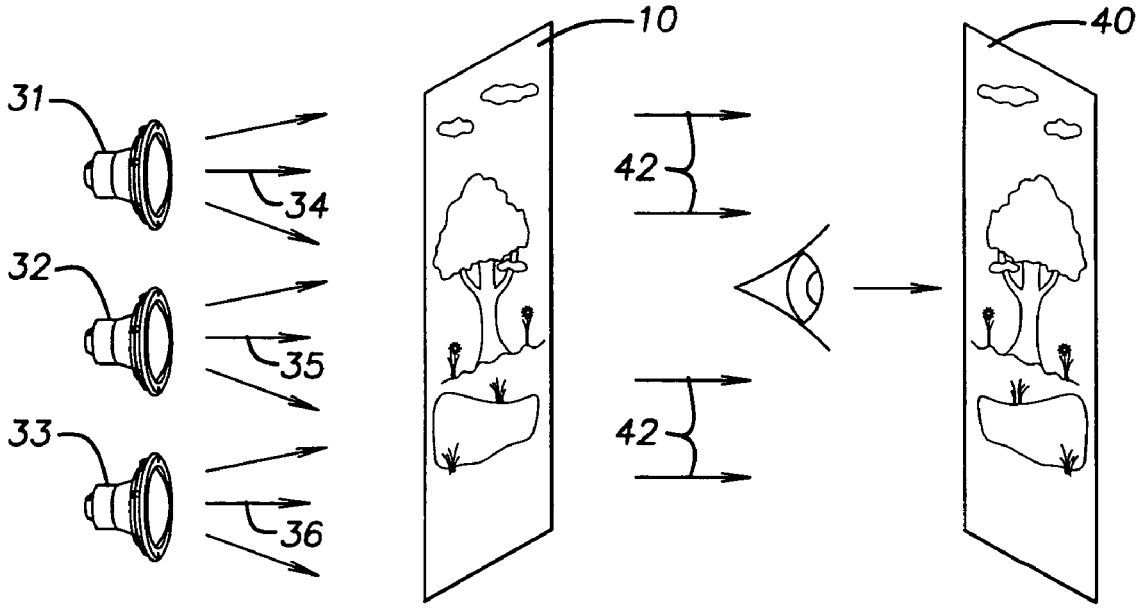
FIG. 4 is a schematic diagram of an implementation of the invention using direct lighting utilizing multiple light sources each of a different color and in which an image is projected onto a viewing surface.

FIG. 4 shows an additional implementation where the image is projected onto a screen 40. The image could also be projected onto a wall, pool bottom, or some other display surface. In such an implementation, the light rays 34, 35, and 36, each of which may be in a different color and/or intensity, travel through the imaged media 10, mixing to at least some extent as shown by light rays 42 that project a color version of the image onto the surface of the screen 40.

The result of the above embodiments is that the image is seen as a color image with appropriate shadowing and color density, despite the presence of grayscaling. This results in a pleasing and effective reproduction of the original image with various different color effect transformations possible. Portions of the image on the imaged media 10 that still retain their original color mostly are reproduced in that original color, while gray-scaled portions reflect the color(s) of the lighting fixture(s).

Furthermore, because the colored portions of the image may have the color density fixed, as discussed above, additional color effects in the viewed image are possible. In addition, swimming and motion effects are possible by varying the lighting intensities and/or colors, leading to a dynamic appearing scene rather than a static one. Positioning a plurality of lights in an offset manner could also provide such motion illusions by switching and/or varying their intensity in a programmed or random manner.

Each of the above implementations can utilize a computerized control system for generating various complex or simple color effects in the resulting image. Further, many different types of light sources may be utilized, including LED, incandescent, fluorescent, laser, etc. sources. Fiber optics might be utilized for light transmission, and the lighting system could be custom or an off-the-shelf system. Furthermore, color wheels or filters rather than individually colored lights can be used to provide the colored lighting.

The invention has been described hereinabove using specific examples; however, it will be understood by those skilled in the art that various alternatives may be used and equivalents may be substituted for elements or steps described herein, without deviating from the scope of the invention. Modifications may be suitable to adapt the invention to a particular situation or to particular needs without departing from the scope of the invention. It is intended that the invention not be limited to the particular implementation described herein.

What is claimed is:

1. A method of making an imaged media, the method comprising:

providing a color image;

creating a modified image by transforming a first color portion of the color image into a gray-scale portion, wherein a second color portion of the color image remaining in color in the modified image;

fixing a color density of the second color portion by increasing an amount of colored pixels in the second color portion;

reproducing said the modified image on an at least partially light transmitting media, the modified image including the gray-scale portion and the second color portion, the second color portion remaining in color on the at least partially light transmitting media;

illuminating the modified image with a colored light source to generate an illuminated image in color; and automatically controlling the colored light source to produce a dynamic coloring effect in which the gray-scale portion is displayed in at least one shaded color and the second color portion is displayed substantially in its original color as in the color image.

2. The method set forth in claim 1, further comprising projecting the illuminated image onto a viewing surface.

3. The method set forth in claim 1, further comprising indirectly backlighting the imaged media with reflected light from the colored light source.

* * * * *